US009540192B2

(12) United States Patent
Kannari

(10) Patent No.: US 9,540,192 B2
(45) Date of Patent: Jan. 10, 2017

(54) SHEET FEEDING APPARATUS AND IMAGE FORMING APPARATUS

(71) Applicant: CANON KABUSHIKI KAISHA, Tokyo (JP)

(72) Inventor: Isao Kannari, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/520,613

(22) Filed: Oct. 22, 2014

(65) Prior Publication Data

US 2015/0123340 A1 May 7, 2015

(30) Foreign Application Priority Data

Nov. 1, 2013 (JP) ..... 2013-228592

(51) Int. Cl.
*B65H 3/52* (2006.01)
*B65H 3/06* (2006.01)
*B65H 5/06* (2006.01)

(52) U.S. Cl.
CPC ..... *B65H 3/0669* (2013.01); *B65H 3/5261* (2013.01); *B65H 5/062* (2013.01); *B65H 2402/33* (2013.01); *B65H 2403/732* (2013.01); *B65H 2404/1341* (2013.01); *B65H 2404/144* (2013.01); *B65H 2404/15212* (2013.01)

(58) Field of Classification Search
CPC ... B65H 3/5246; B65H 3/5253; B65H 3/5261; B65H 2404/1122; B65H 2404/11221; B65H 2404/1341; B65H 2404/4121; B65H 2301/4234; B65H 3/06; B65H 3/32; B65H 3/34; B65H 3/46; B65H 3/56; B65H 2301/42344; B65H 3/565
USPC ..... 271/121, 122, 125
See application file for complete search history.

(56) References Cited

U.S. PATENT DOCUMENTS 4,895,359 A * 1/1990 Ookawa ..... G06M 7/06 271/125
6,120,018 A * 9/2000 Amano ..... 271/121
7,887,042 B2 * 2/2011 Sheng ..... B65H 3/063 271/121
8,480,074 B2 7/2013 Ubayashi et al.
8,511,674 B2 8/2013 Koga
(Continued)

FOREIGN PATENT DOCUMENTS

JP 64-028136 A 1/1989
JP 2000-143051 A 5/2000
(Continued)

*Primary Examiner* — Thomas Morrison
(74) *Attorney, Agent, or Firm* — Fitzpatrick, Cella, Harper & Scinto

(57) ABSTRACT

A separation roller is provided in a first end portion of a separation roller shaft through a torque limiter. The separation roller is provided to be able to come into pressure contact with a conveying roller rotatably supported by a conveying roller shaft. A support portion supports the separation roller in a cantilever condition and is formed to be elastically deformable. The support portion supports the separation roller shaft such that the separation roller shaft is inclined by a predetermined angle with respect to the conveying roller shaft such that the first end portion of the separation roller shaft is positioned upstream in a sheet conveying direction of a second end portion in a state in which the conveying roller is not driven.

14 Claims, 7 Drawing Sheets

(56) References Cited

U.S. PATENT DOCUMENTS

| | | | | |
|---|---|---|---|---|
| 2004/0245705 | A1* | 12/2004 | Taniyama | 271/121 |
| 2014/0159299 | A1* | 6/2014 | Yano | B65H 1/12<br>271/4.1 |

FOREIGN PATENT DOCUMENTS

| | | | |
|---|---|---|---|
| JP | 2003-201045 | A | 7/2003 |
| JP | 2006-225164 | A | 8/2006 |

* cited by examiner

SHEET FEEDING APPARATUS AND IMAGE FORMING APPARATUS

BACKGROUND OF THE INVENTION

Field of the Invention

The present disclosure relates to a sheet feeding apparatus.

Description of the Related Art

A certain conventional image forming apparatus such as a printer, a copier, and a facsimile is configured to feed a sheet stacked in a sheet feed cassette by a pickup roller provided in a sheet feeding apparatus and to convey the sheet to an image forming portion. The sheet feeding apparatus includes a separating portion configured to separate the sheet one by one even if two or more sheets are delivered by the pickup roller.

As one example of the separating portion, there is a retard separation type separating portion including a feed roller rotating in a same direction with the pickup roller and a retard roller that comes into pressure contact with the feed roller with a pressure contact force (referred to as a 'nip pressure' hereinafter) having a predetermined magnitude.

A driving force is applied to the retard roller in a direction opposite from the normal direction (referred to as a 'reverse rotation direction' hereinafter) in which the sheet is conveyed and which is the same direction with that of the feed roller through an intermediary of a torque limiter with a certain torque (referred to as 'rotation torque' hereinafter). That is, the retard roller is capable of rotating both in the normal and reverse rotation directions.

This retard separation type separating portion is configured to prevent sheets from being fed doubly by reversely rotating the retard roller when two or more sheets enter a nip portion (referred to as a 'separation nip portion' hereinafter) between the retard roller and the feed roller. In a case where one sheet enters or no sheet enters the separation nip portion, the retard roller normally rotates together with the feed roller.

Concerning the retard separation type separating portion, a configuration of attaching each roller at an end portion on a free end side of a driving shaft supported in a cantilever condition is adopted more often lately to improve replicability of the retard and the feed rollers as disclosed in U.S. Pat. No. 8,511,674. It is possible to readily carry out a roller replacing work by removing each roller from the free end of the driving shaft by releasing a lock mechanism provided at an end portion of each roller.

However, a sheet feeding apparatus as described in U.S. Pat. No. 8,511,674 causes the following problems. That is, if the retard roller comes into pressure contact with the feed roller and the feed roller rotates in separating and feeding a sheet, the retard roller receives a load from the feed roller and the free end side of the driving shaft supporting the feed roller is displaced to a downstream side. Thereby, the retard roller is misaligned from the feed roller, possibly causing uneven wear of the retard roller and the feed roller. If the retard roller or the feed roller unevenly wears, there may be a problem that durability of the retard roller or the feed roller drops, thus also dropping sheet conveyance performance.

SUMMARY OF THE INVENTION

According to one aspect of the invention, a sheet feeding apparatus includes a conveying roller configured to convey a sheet, a separation roller configured to be able to come into pressure contact with the conveying roller, a conveying roller shaft to which the conveying roller is attached, a separation roller shaft supported in a cantilever condition and having a first end portion to which the separation roller is attached through a torque limiter, and a supporting portion configured to support the separation roller shaft in a state in which the separation roller shaft is inclined in the sheet conveying direction by a predetermined angle with respect to the conveying roller shaft and to elastically deform such that the separation roller shaft is substantially paralleled with the conveying roller shaft by a force received by the separation roller from the driving conveying roller.

According to another aspect of the invention, a sheet feeding apparatus includes a conveying roller configured to convey a sheet, a conveying roller shaft supporting the conveying roller, a separation roller provided to be able to come into pressure contact with the conveying roller, a separation roller shaft supporting the separation roller in a first end portion thereof through a torque limiter, and a support portion supporting the separation roller shaft in a cantilever condition and formed to be elastically deformable, the support portion supporting the separation roller shaft such that the separation roller shaft is inclined by a predetermined angle with respect to the conveying roller shaft such that the first end portion of the separation roller shaft is positioned upstream in the sheet conveying direction of a second end portion of the separation roller shaft in a state in which the conveying roller is not driven.

Further features of the present invention will become apparent from the following description of exemplary embodiments (with reference to the attached drawings).

DESCRIPTION OF THE EMBODIMENTS

Figure 1:
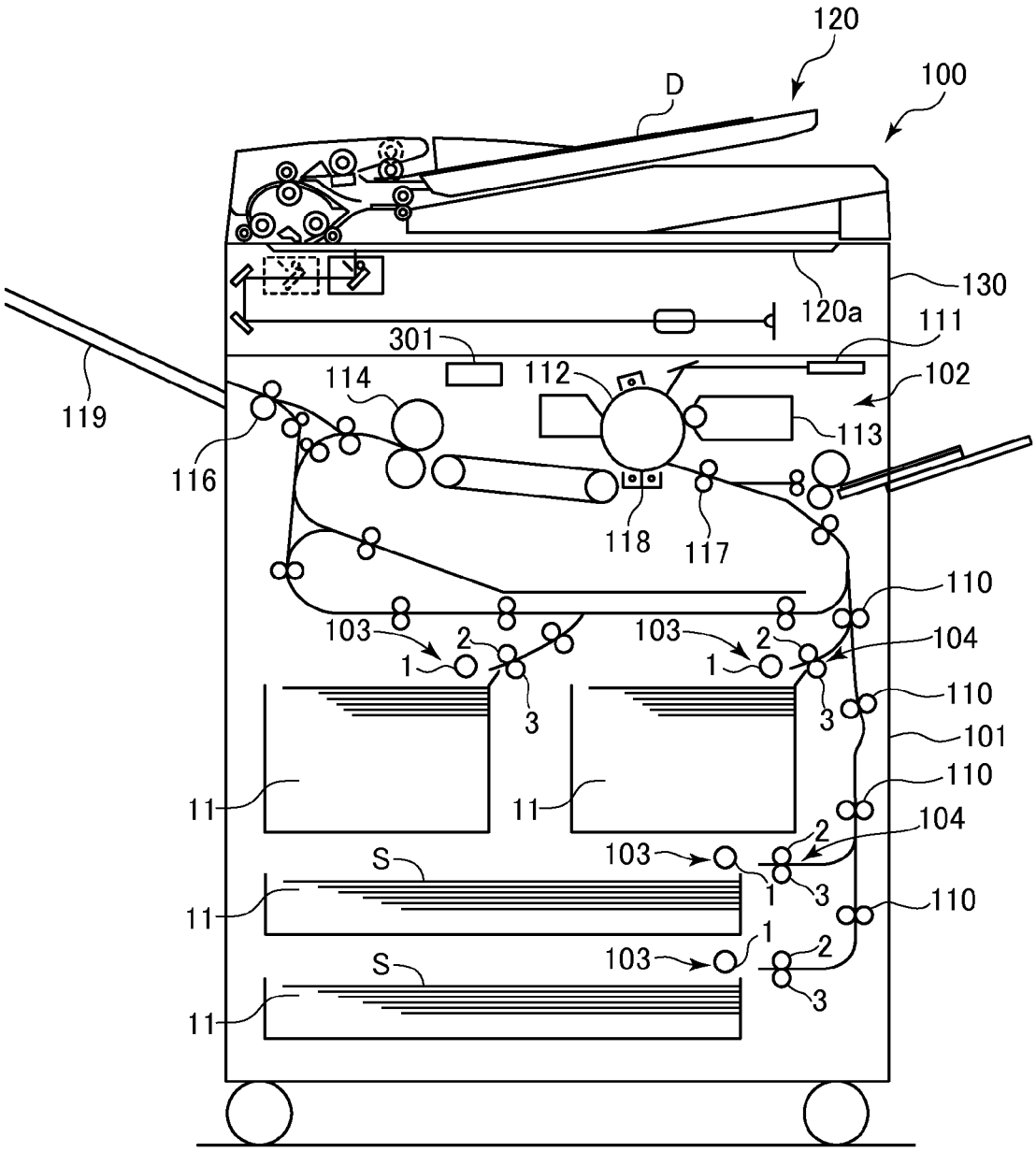
FIG. 1 illustrates a schematic configuration of a printer which is one example of an image forming apparatus including a sheet feeding apparatus according to an embodiment of the present disclosure.

An embodiment of the present disclosure will be described below with reference to the drawings. FIG. 1 is a section view schematically illustrating a configuration of a printer which is one example of an image forming apparatus including a sheet feeding apparatus of the embodiment of the present disclosure.

In FIG. 1, the printer 100 includes a printer body 101. The printer 100 is provided with an image reading portion 130 reading a document D placed on a platen glass 120*a* at an upper part of the printer body 101. The image reading portion 130 is configured to also read a document D automatically fed by an auto document feeder 120. The printer 100 is also provided with an image forming portion 102 under the image reading portion 130 and a sheet feeding apparatus 103 feeding a sheet S to the image forming portion 102.

Here, the image forming portion 102 includes a photosensitive drum 112, a developer 113, a laser scanner unit 111, a transfer charger 118, a fixing portion 114, and others. As shown in FIG. 1, the printer 100 also includes a CPU 301, i.e., a control portion, controlling an image forming operation of the printer body 101 and a sheet feeding operation of the sheet feeding apparatus 103.

Next, the image forming operation of the printer 100 having the abovementioned configuration will be described. When an image reading signal is output from the CPU 301 provided in the printer body 101 to the image reading portion 130, the image of the document D is read by the image reading portion 130. Thereafter, a laser beam corresponding to this electric signal is irradiated from the laser scanner unit 111 to the photosensitive drum 112. At this time, the photosensitive drum 112 is charged in advance, so that an electrostatic latent image is formed when the laser beam is irradiated. Then, a toner image is formed on the photosensitive drum by developing the electrostatic latent image by the developer 113.

Meanwhile, in response to an output of a sheet feed signal from the CPU 301 to the sheet feeding apparatus 103, a pickup roller 1 of the sheet feeding apparatus 103 rotates and the sheet S stored in a sheet feed cassette 11 is delivered. The delivered sheet S is separated by a separating portion 104 provided in the sheet feeding apparatus 103 one by one and is conveyed to a registration roller pair 117 by a plurality of conveying roller pair 110.

Thereafter, a skew of the sheet S is corrected by the registration roller pair 117 and then the sheet S is delivered to the transfer charger 118 in synchronism with the toner image on the photosensitive drum 112. The toner image on the photosensitive drum 112 is transferred to the sheet S by the transfer charger 118 and then is conveyed to the fixing portion 114. Thereafter, the toner image is fixed to the sheet S by being heated and pressed by the fixing portion 114 and the sheet S is discharged by a discharging roller 116 out of the printer body 101 to a discharged sheet tray 119.

Figure 7:
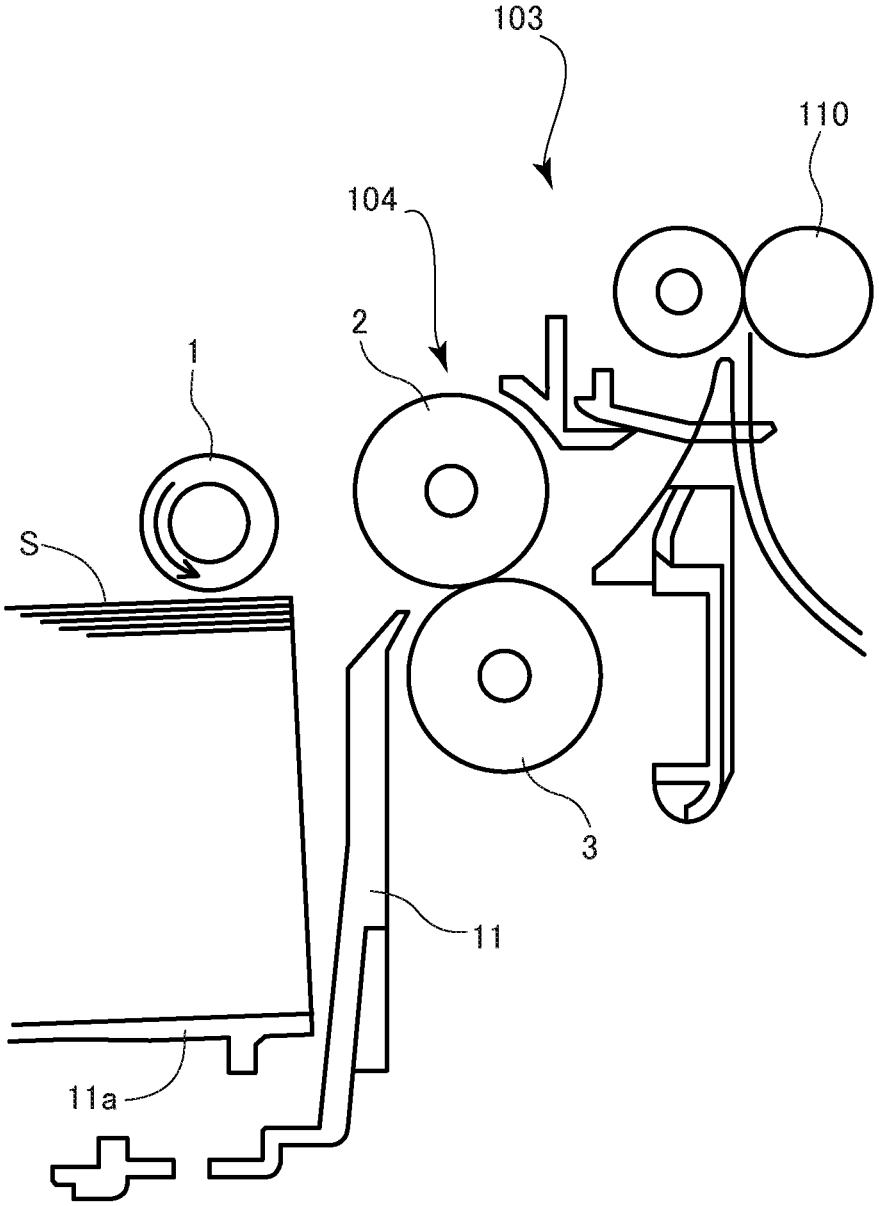
FIG. 7 schematically illustrates a configuration of the sheet feeding apparatus.

Next, the sheet feeding apparatus 103 will be described with reference to FIGS. 1 and 7. It is noted that FIG. 7 is a schematic diagram illustrating a configuration of the sheet feeding apparatus 103. As illustrated in FIG. 7, the sheet feed cassette 11 storing the sheet S is provided with a liftable tray 11*a* and the sheet is stacked on an upper surface of the tray 11*a*.

The sheet feed cassette 11 is removably attached to the printer body 101, so that it is possible to perform such works as replenishment of the sheet by drawing out the cassette 11 in a direction vertical to a sheet surface of FIG. 1. The pickup roller 1 is disposed above the sheet feed cassette 11. The pickup roller 1 is provided liftably by a drive unit such as a solenoid (not illustrated) and is configured to come into contact with an upper surface of the sheet on the tray 11*a* and to rotate to deliver the sheet.

Figure 2:
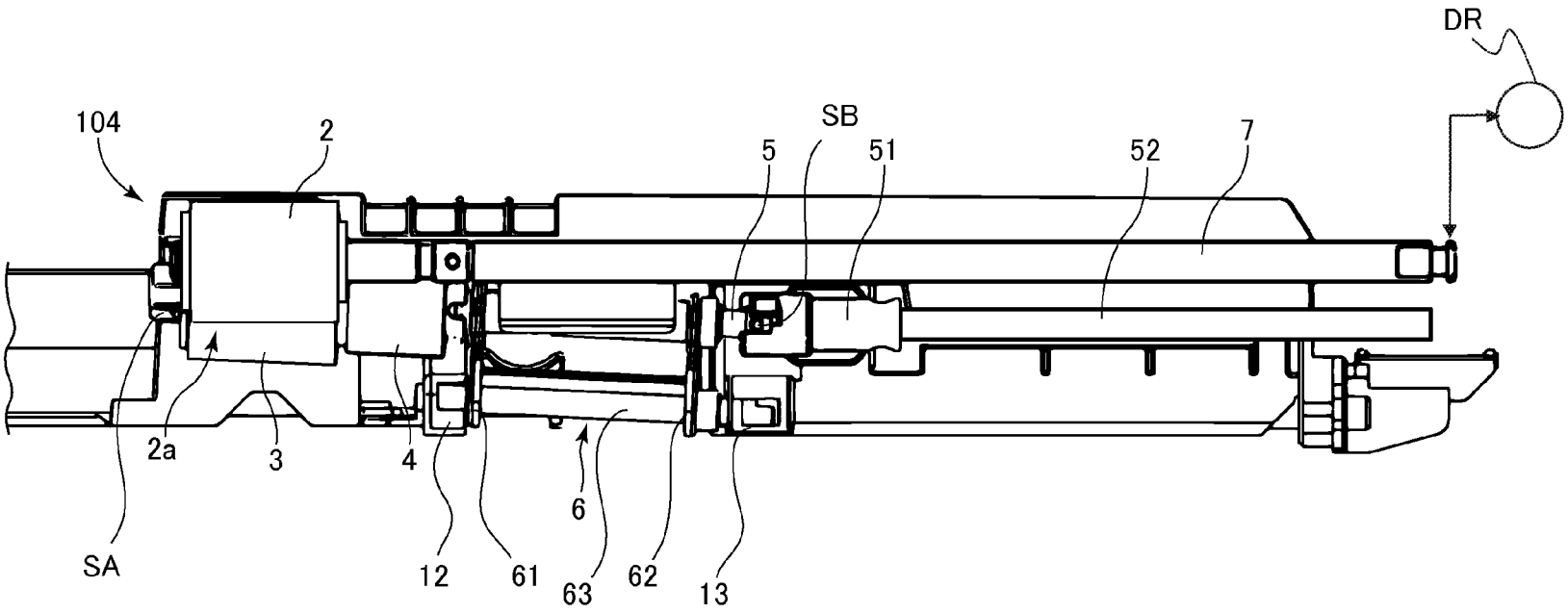
FIG. 2 is a plan view illustrating a separating portion provided in the sheet feeding apparatus.

The separating portion 104 of the sheet feeding apparatus 103 will be described with reference to FIG. 2. FIG. 2 is a plan view illustrating the separating portion 104 configured to be able to deliver the sheet by separating one by one. The separating portion 104 is disposed downstream in the sheet conveying direction of the pickup roller 1 and includes a feed roller 2, i.e., a conveying roller, conveying the sheet delivered by the pickup roller 1 and a separation roller 3 capable of coming into pressure contact with the feed roller 2.

The separation roller 3 composes a separation nip portion 2*a* separating the sheet one by one together with the feed roller 2 and is configured to be rotated (driven) together with the feed roller 2. The feed roller 2 is rotatable in the sheet conveying direction as a driving force is transmitted from a driving source DR such as a motor to a feed roller shaft 7 supporting the feed roller 2. The pickup roller 1 is also rotatable in the sheet conveying direction as the driving force is transmitted from the feed roller shaft 7 to which the driving force is transmitted through a gear train not shown.

Furthermore, the separating portion 104 includes a separation roller shaft 5, i.e., a separation roller shaft, to which the separation roller 3 is attached to a first end portion SA and the feed roller shaft 7, i.e., a conveying roller shaft to which the feed roller 2 is attached at a first end thereof. The separation roller 3 is supported by the separation roller shaft 5 through a torque limiter 4. The separation roller shaft 5 is connected to a supporting shaft 52 fixed to a side plate not illustrated of the printer body 101 through a universal joint 51.

It is noted that instead of the support shaft 52, the separation roller shaft 5 may be connected the driving shaft to which the driving force is transmitted through the universal joint 51. In this case, the separation roller shaft 5 is rotated by the driving force transmitted through the driving shaft and the universal joint 51 and the rotation of the separation roller shaft 5 is transmitted to the separation roller 3 provided at a first end of the separation roller shaft 5 through the torque limiter 4. It is noted that in the case of the configuration in which the driving force is transmitted to the separation roller shaft 5, the separation roller 3 is rotated by the driving force in the direction opposite from the sheet feeding direction.

A limit value of the torque limiter 4 is set to be greater than a friction force generated between a plurality of sheets S simultaneously fed by the pickup roller 1. The limit value of the torque limiter 4 is also set to be smaller than a friction force generated between the sheet S and the feed roller 2. It is noted that the limit value is an upper limit value of putting the separation roller 3 into a non-rotatable state by a rotation torque applied to the torque limiter 4 from the separation roller 3 in feeding the sheet. Therefore, in a case where the rotation torque less than the limit value is applied from the separation roller 3 to the torque limiter 4, the separation roller 3 maintains a stopped state. Furthermore, in a case where the rotation torque greater than the limit value is applied from the separation roller 3 to the torque limiter 4, the separation roller 3 is rotated.

Thereby, in cases where only one sheet enters or no sheet enters the separation nip portion 2*a* in an sheet feeding operation, the rotation torque applied from the separation roller 3 to the torque limiter 4 exceeds the limit value and the separation roller 3 rotates together with the sheet S or the feed roller 2. Still further, in a case where two or more sheets enter the separation nip portion 2*a* between the feed roller 2 and the separation roller 3, the separation roller 3 is stopped by the torque limiter 4 and the sheets are separated one by one. It is noted in the configuration in which reverse drive is inputted from the driving source to the separation roller 3, if two or more sheet enter the separation nip portion 2*a* between the feed and separation rollers 2 and 3, the rotation torque applied to the torque limiter 4 does not exceed the limit value and the separation roller 3 rotates in the direction opposite from the sheet feeding direction through the torque limiter 4. Then, the sheets are separated one by one by the rotation in the opposite direction.

Figure 3:
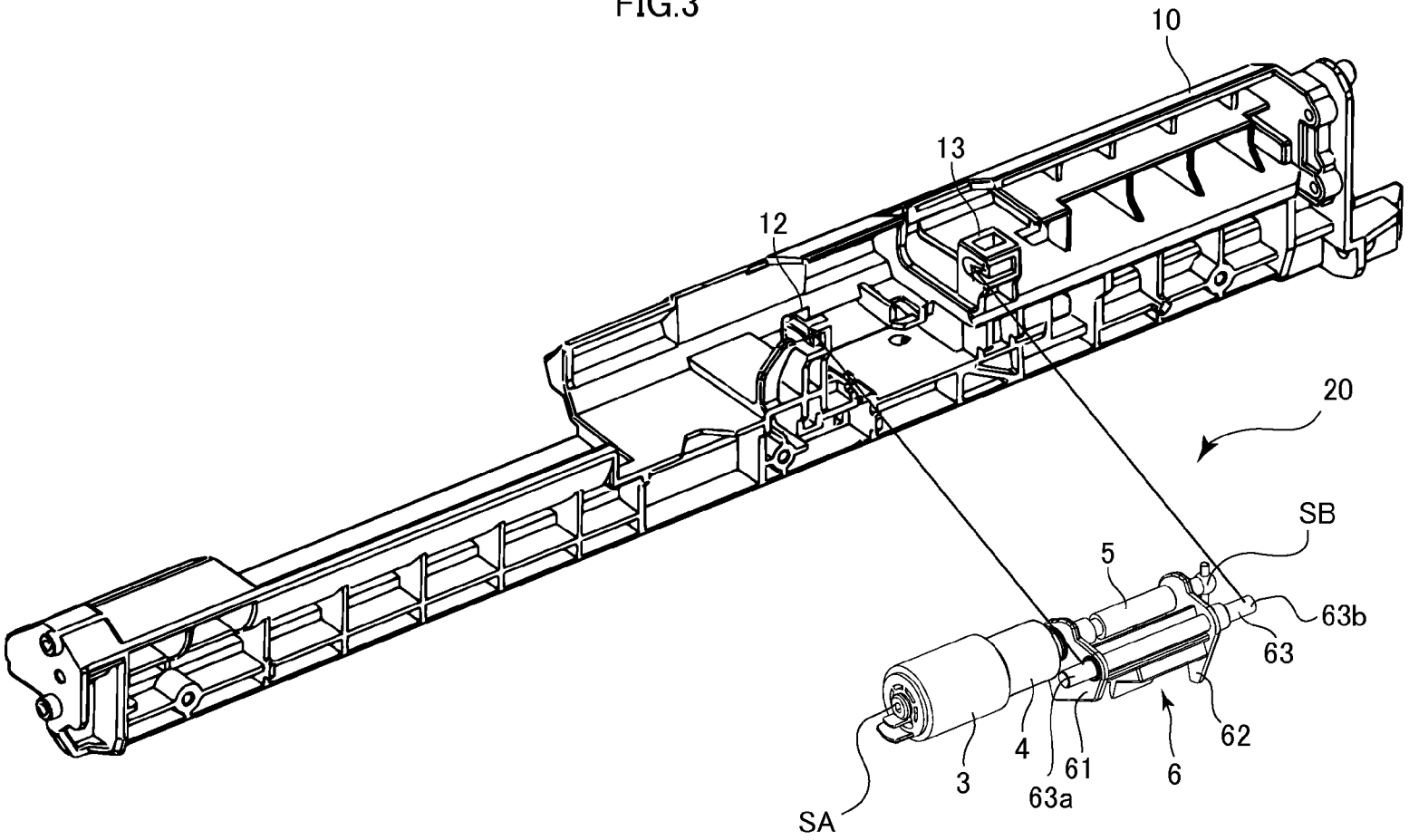
FIG. 3 is a perspective view illustrating a mounting structure of a separation roller.

As illustrated in FIG. 3, the separation roller shaft 5 is rotatably supported by a holding portion 6 having side plates 61 and 62 provided in parallel in an axial direction of the separation roller shaft 5. The side plates 61 and 62, i.e., shaft holding portion supports the separation roller shaft 5 and the swing support shaft 63 in a condition in which those shafts run in parallel. It is noted that in the present embodiment, the sideplate 62 supports a second end portion SB of the separation roller shaft 5 and the side plate 61 supports a part between the second end portion SB of the separation roller shaft 5 and the separation roller 3. This configuration permits to support the separation roller shaft 5 in a cantilever condition by the holding portion 6 and to make the first end portion SA of the separation roller shaft 5 on which the separation roller 3 is rotatably supported to be a free end.

Furthermore, the holding portion 6 includes a swing supporting shaft 63 fixed to the side plates 61 and 62 and is disposed in parallel with the separation roller shaft 5. The swing supporting shaft 63 is configured such that shaft end portions 63*a* and 63*b* are supported by first and second bearing portions 12 and 13, i.e., a bearing portion, provided integrally with a frame 10 fixed to the printer body 101 that also serves as a sheet feeding apparatus body. Then, since the holding portion 6 is supported pivotably in a vertical direction by the first and second bearing portions 12 and 13 through the swing supporting shaft 63, the separation roller 3 is swingably and rotatably supported in the vertical direction. The holding portion 6 and the frame 10 including the first and second bearing portions 12 and 13 compose a support portion 20.

Figure 4A:
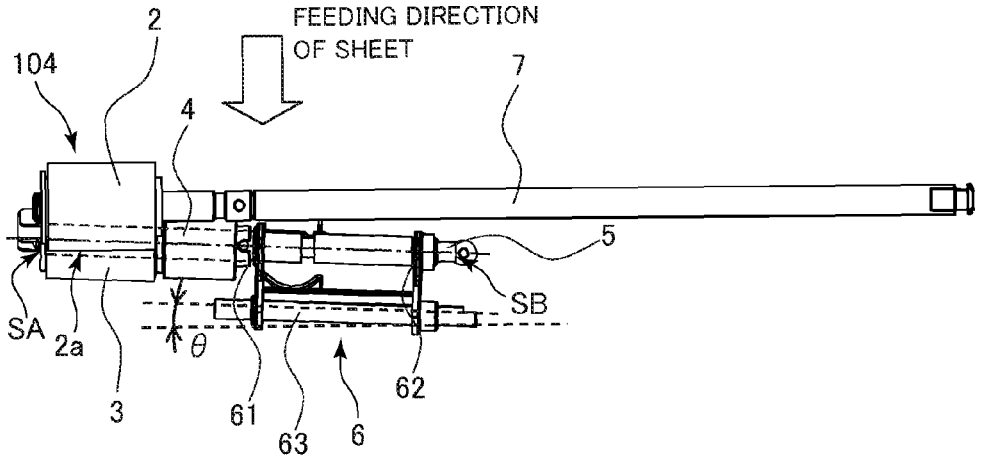
FIG. 4A illustrates a state in which a separation roller shaft is held by being inclined at a predetermined angle with respect to a separation roller shaft.

The frame 10 is formed of synthetic resin and is capable of being elastically deformed to a certain extent. In the present embodiment, the first and second bearing portions 12 and 13 are arranged such that the separation roller shaft 5 is inclined with respect to the feed roller shaft 7 by a predetermined angle θ in the sheet conveying direction as illustrated in FIG. 4A when the holding portion 6 is mounted on the first and second bearing portions 12 and 13. It is noted that while a material of the frame 10 may be appropriately selected in consideration of an elastic deformation rate, PC+ABS (mixed resin of polycarbonate acrylonitrile-butadiene-styrene) resin is used in the present embodiment. It is also possible to use a synthetic rubber or the like.

Thereby, as illustrated in FIG. 4A, the separation roller shaft 5 is held in inclination such that the first end portion SA on which the separation roller 3 is mounted is positioned upstream side in the sheet conveying direction of the second end portion SB of the separation roller shaft 5. As a result, when the holding portion 6 is mounted on the first and second bearing portions 12 and 13, i.e., in a state in which there is no load before starting the sheet feeding operation, the separation roller 3 is inclined by the predetermined angle θ in the sheet conveying direction with respect to the feed roller 2 such that the separation roller 3 is positioned upstream in the sheet conveying direction of the feed roller 2.

Meanwhile, in the present embodiment, the frame 10 is formed of the synthetic resin and is capable of being elastically deformed to a certain extent. When the sheet is started to be fed and the separation nip portion 2*a* is formed between the feed and separation rollers 2 and 3, the separation roller 3 receives a force from the feed roller 2 in a downstream direction in the sheet conveying direction. This force acts on a vicinity of the first and second bearing portions 12 and 13 of the frame 10 through the holding portion 6 and the first and second bearing portions 12 and 13 are elastically deformed.

At this time, since the separation roller shaft 5 is supported by the holding portion 6 in the cantilever condition, the first bearing portion 12 positioned on the separation roller 3 side among the first and second bearing portions 12 and 13 receives a force greater than that received by the second bearing portion 13 located on the opposite side. Due to that, the first bearing portion 12 deforms elastically more than the second bearing portion 13, and the first end portion SA of the separation roller shaft 5 pivots to the downstream side in the sheet conveying direction with a fulcrum of the second bearing portion 13.

Figure 4B:
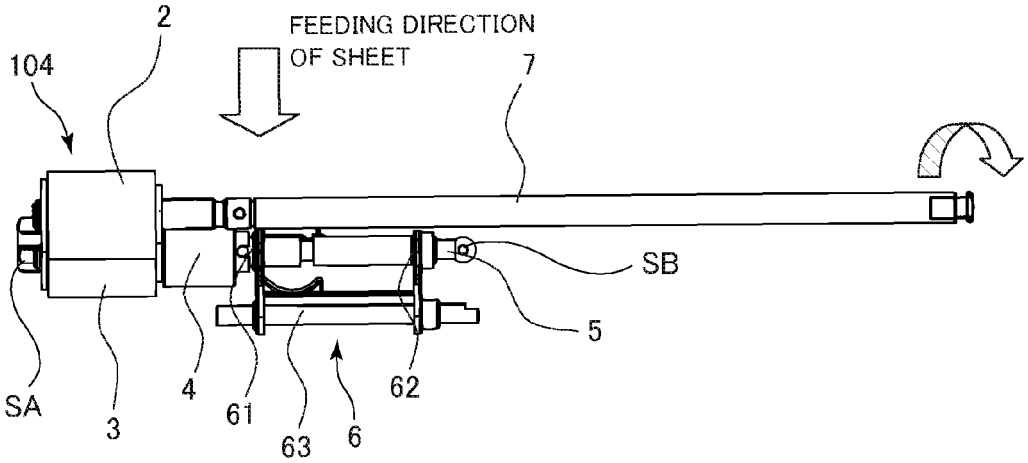
FIG. 4B illustrates a state in which the separation roller shaft is substantially in parallel with the separation roller shaft.

In the present embodiment, since the separation roller shaft 5 is held in inclination with the predetermined angle θ with respect to the feed roller shaft 7 in advance, the frame 10 deforms elastically such that the predetermined angle θ is decreased when the separation roller 3 comes into pressure contact with the feed roller 2 and receives such a force that displaces the feed roller 2 in the downstream direction in the sheet conveying direction. Furthermore, the predetermined angle θ is set to be an angle by which the separation roller shaft 5 becomes substantially in parallel with the feed roller shaft 7 as shown in FIG. 4B when the feed roller 2 rotates in a condition in which the separation roller 3 is directly in pressure contact with the feed roller 2 or in a condition in which only one sheet enters the separation nip portion 2*a* and is being in pressure contact. Thereby, when the sheet is started to be fed, the separation roller shaft 5 pivots to the downstream side in the sheet conveying direction by the predetermined angle θ with respect to the feed roller shaft 7 while elastically deforming the first and second bearing portions 12 and 13 and the separation roller 3 comes into pressure contact with the feed roller 2 with a substantially uniform contact pressure throughout an entire region in the axial direction of the roller.

As described above, the separation roller shaft 5 is inclined in advance with respect to the feed roller shaft 7 by the predetermined angle θ such that the first end portion SA to which the separation roller 3 is attached is positioned on the upstream side in the sheet conveying direction more than the second end portion SB in the present embodiment. Then, when the sheet is started to be fed, the separation roller 3 comes into direction pressure contact with the feed roller 2 or through one sheet, and the separation roller 3 rotates together with the feed roller 2, the first and second bearing portions 12 and 13 are deformed elastically. Thereby, the separation roller shaft 5 pivots to the downstream side in the sheet conveying direction by the predetermined angle θ. Thus, when the sheet is started to be fed, the separation roller shaft 5 pivots and thereby the feed roller 2 and the separation roller 3 come into contact homogeneously. As a result, it is possible to improve balance of the nip pressure within the separation nip portion 2*a*, to improve durability of the separation and feed rollers 3 and 2, and to improve sheet conveying performance of the separation nip portion 2*a*.

It is noted that in the case where two or more sheets enter the separation nip portion 2*a*, the pivoting angle of the separation roller shaft 5 to the downstream side in the sheet conveying direction is reduced since the load applied to the separation roller 3 by the feed roller 2 is reduced. Therefore, the separation roller shaft 5 becomes slightly unparallel to the feed roller shaft 7 during when the separation roller 3 separates the sheet. However, since a time during which the separation roller 3 stops to separate the sheet in this state is not so long, wear or the like of the roller is not greatly accelerated even if the nip pressure in the separation nip portion 2*a* is imbalanced more or less.

Figure 5A:
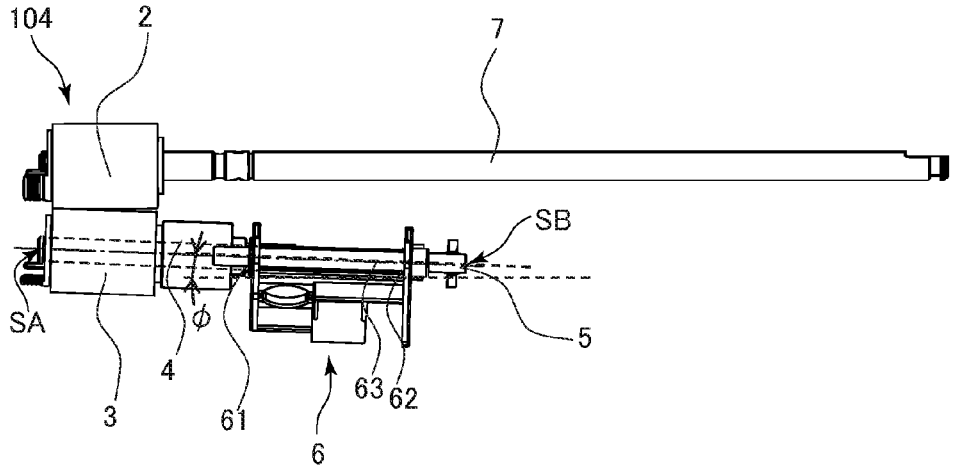
FIG. 5A illustrates a separating portion viewed from a downstream side in a sheet conveying direction.

Furthermore, in the present embodiment, as illustrated in FIG. 5A showing the separating portion 104 viewed from the downstream side in the sheet conveying direction when the holding portion 6 is mounted, the first and second bearing portions 12 and 13 are configured such that the separation roller shaft 5 is inclined in the vertical direction with respect to the feed roller shaft 7 by a predetermined inclination angle (predetermined angle) ϕ. That is, when the holding portion 6 is mounted on the first and second bearing portions 12 and 13, the separation roller shaft 5 is held in the state in which the separation roller shaft 5 is inclined such that the first end portion SA of the separation roller shaft 5 is closer to the feed roller shaft 7 than the second end portion SB.

In the state of FIG. 5A, the sheet feeding apparatus 103 is put into a sheet feeding standby state. In this state, a corner of a first end portion of the separation roller 3 is kept in pressure contact with a peripheral surface of the feed roller 2 because a bias spring 8, i.e., a bias member, is set to have a relatively weak elastic force. It is noted that a swing support shaft 63 supporting the separation roller 3 pivotably in the vertical direction is disposed under the separation roller 3 on the downstream side in the present embodiment. Due to that, when the feed roller 2 rotates and the separation roller 3 rotates together with the feed roller 2, the holding portion 6 pivots centering on the swing support shaft 63 in the direction in which the separation roller 3 comes into pressure contact with the feed roller 2. This is a configuration of so-called "free-to-bite-in".

Figure 5B:
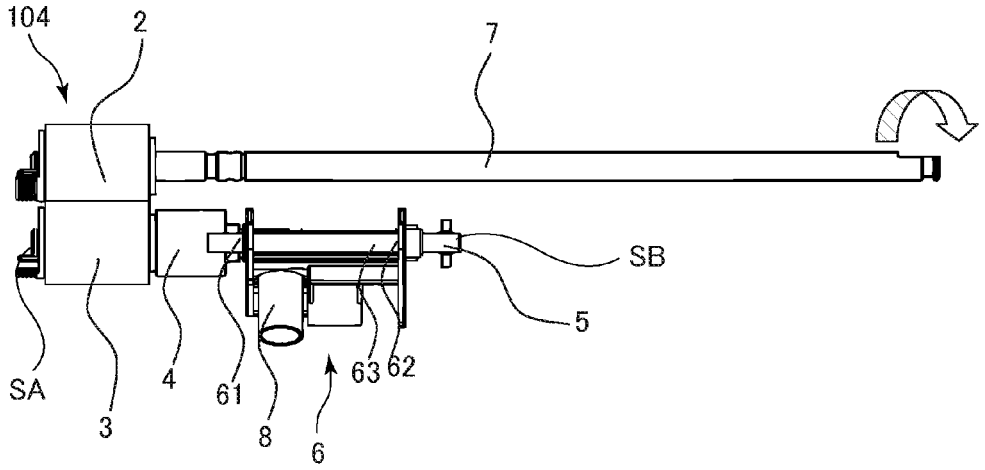
FIG. 5B illustrates a state in which the separation roller shaft is made substantially in parallel to the separation roller shaft.

Therefore, when the feed roller 2 rotates and the separation roller 3 rotates together with the feed roller 2, the separation roller 3 moves toward the feed roller 2 and peripheral surfaces of the feed roller 2 and the separation roller 3 come into pressure contact in well-balanced manner as shown in FIG. 5B. A state shown in FIG. 5B is a state allowing the sheet to be separated and fed.

It is noted that the separation roller 3 is configured such that it is separated from the feed roller 2 by resisting against the elastic force of the bias spring 8 by a releasing spring not shown whose elastic force is set to be stronger than the elastic force of the bias spring when the sheet feed cassette 11 is drawn out of the printer 100 in general. While the present embodiment is described assuming the configuration in which the separation roller 3 is brought into contact with the feed roller 2 by the configuration of 'free-to-bite-in' as described above, the present disclosure is not limited to that. For instance, the separation roller shaft 5 is set such that the separation roller shaft 5 is inclined by the predetermined angle ϕ vertically with respect to the feed roller shaft 7 in a state in which the sheet feed cassette 11 is drawn out by the releasing spring and the separation roller 3 is separated from the feed roller 2. Then, when the sheet feed cassette 11 is attached to the printer 100, the elastic force of the releasing spring is released, and the peripheral surface of the separation roller 3 may be brought into contact with the peripheral surface of the feed roller 2 by biasing the holding portion 6 by using the bias spring 8 whose elastic force is relatively strong. That is, the separation roller 3 may be brought into contact with the feed roller 2 without using the configuration of 'free-to-bite-in'.

Here, the separation roller shaft 5 is supported by the holding portion 6 in the cantilever condition so that replacement of the separation roller 3 is simplified. Then, in the sheet feeding condition, the separation roller 3 is brought into contact with the rotating feed roller 2 by receiving the forces of the bias spring 8 and of 'free-to-bite-in' through the holding portion 6 and receives a reaction force from the feed roller 2. This reaction force acts on the vicinity of the first and second bearing portions 12 and 13 of the frame 10 through the holding portion 6, and the first and second bearing portions 12 and 13 deform elastically.

At this time, since the separation roller shaft 5 is supported by the holding portion 6 in the cantilever condition, a greater force is applied to the first bearing portion 12 positioned on the separation roller 3 side among the first and second bearing portions 12 and 13 than the second bearing portion 13 on the opposite side. Due to that, the first bearing portion 12 is elastically deformed more than the second bearing portion 13, and the first end portion SA of the separation roller shaft 5 pivots downward with a fulcrum of the second bearing portion 13.

In the present embodiment, the predetermined inclination angle ϕ is set in advance such that the separation roller shaft 5 and the feed roller shaft 7 become substantially in parallel with each other when the separation roller shaft 5 pivots downward as illustrated in FIG. 5B. Thereby, when the separation roller 3 rotates together with the feed roller 2, the separation roller shaft 5 pivots downward by the predetermined inclination angle ϕ with respect to the feed roller shaft 7 while elastically deforming the first and second bearing portions 12 and 13 and the separation roller 3 is substantially paralleled with the feed roller shaft 7, so that the separation roller 3 comes into pressure contact with the feed roller 2 with the substantially uniform contact pressure throughout the entire region in the axial direction of the rollers. As a result, it is possible to improve the balance of the nip pressure in the separation nip portion 2*a*, to improve the durability of the separation and feed rollers 3 and 2, and to improve the sheet conveyance performance.

That is, in the present embodiment, in the state in which no load is applied to the separation roller 3 from the rotating feed roller 2, the separation roller 3 is held in the state of being inclined by the predetermined angle θ in the upstream side in the sheet conveying direction as illustrated in FIG. 4A. Furthermore, as illustrated in FIG. 5A, the separation roller 3 is held in the state in which the separation roller 3 is inclined by the predetermined inclination angle ϕ upward that is a direction in which the separation roller 3 comes into pressure contact with the feed roller 2 until when the separation roller 3 rotates together with the feed roller 2.

Then, when the sheet S is started to be fed and the separation roller 3 rotates together with the feed roller 2 in the state of being in pressure contact with the feed roller 2, a force is applied to the first end portion SA of the separation roller shaft 5 supported in the cantilever condition in a downward direction and the downstream direction in the sheet conveying direction. Thereby, the first and second bearing portions 12 and 13 are deformed elastically and the separation roller 3 is inclined in a direction of cancelling (decreasing) the predetermined angle θ and the predetermined inclination angle ϕ. As a result, the feed and separation rollers 2 and 3 come into pressure contact with each other with the substantially uniform contact pressure throughout the entire region in the axial direction of the rollers and it is possible to improve the balance of the nip pressure in the separation nip portion 2*a*.

It is noted that the predetermined angles θ and ϕ are set such that the separation roller 3 is substantially paralleled with the feed roller 2 when the feed roller 2 is driven in the state in which the separation roller 3 and the feed roller 2 are in pressure contact with each other.

For example, under the following conditions, specific values of the predetermined angles θ and ϕ are θ=0.4° and ϕ=0.45°.

Diameter of Roller: 18 mm

Pressure contact force of Separation roller: 3.4 N

Value of Torque limiter: 324 g·cm

Span between Support portions of Separation roller shaft (distance between the side plate 61 and side plate 62): 31 mm Span between Support portion of Separation roller shaft and Separation roller Fitting portion (distance between the side plate 61 and the separation roller 3): 33 mm It is noted that it is possible to maintain the performance practically having no problem if an angular shift of the predetermined angles θ and ϕ is around ±0.2°.

As described above, in the present embodiment, the separation roller shaft 5 is held in inclination by the first and second bearing portions 12 and 13. Then, when the separation roller 3 is driven by the feed roller 2, the first and second bearing portions 12 and 13 are elastically deformed such that the separation roller shaft 5 is substantially paralleled with the feed roller shaft 7. Typically, a time during which the separation roller 3 is driven by the feed roller 2 in feeding one sheet is much longer than a time during which the separation roller 3 is stopped and separates the sheet. Due to that, the wear of the feed and separation rollers 2 and 3 is largely affected more by the time during which the separation roller 3 is driven by the feed roller 2.

However, according to the present embodiment, it is possible to prevent misalignment between the feed and separation rollers 2 and 3 and to uniform the balance of the contact pressure of the separation nip portion 2*a* when the separation roller 3 is driven by the feed roller 2. As a result, since the feed and separation rollers 2 and 3 wear uniformly, the durability of the sheet feeding apparatus is improved. Furthermore, the conveying force in the separation nip portion 2*a* is uniformed, so that a sheet separating performance is improved and it becomes possible to prevent the sheet from being skewed when the separation roller 3 is driven by the feed roller 2.

Furthermore, it is possible to improve the replaceability of the separation roller 3 by supporting the separation roller 3 in the cantilever condition like the present embodiment. Due to that, since it is not necessary to increase stiffness of the separation roller 3 to reduce a frequency of the replacement, it is possible to restrain the cost. Furthermore, it is possible to make the separation and feed rollers in common, so that it is possible to reduce manufacturing and assembling costs.

Figure 6:
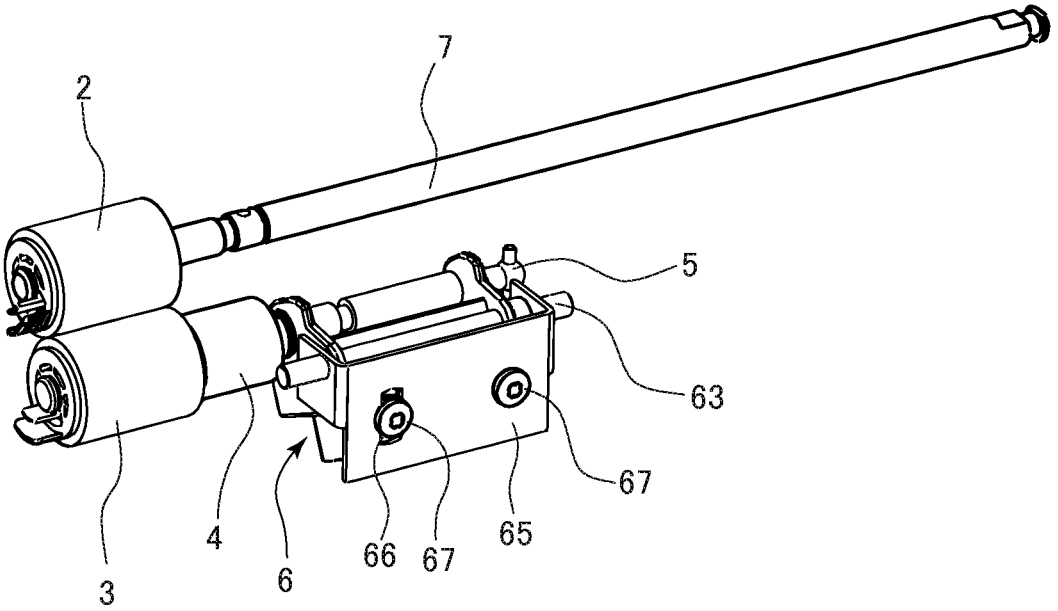
FIG. 6 illustrates the sheet feeding apparatus provided with an adjusting member adjusting an inclination angle of the separation roller shaft.

Moreover, since the predetermined angle θ and the predetermined inclination angle ϕ are affected by variation or the like of component tolerances, the mounting position of the holding portion 6 may be made adjustable and the predetermined angle θ and the predetermined inclination angle ϕ may be made adjustable. As a configuration for that, an adjusting member 65 which rotatably supports the swing support shaft 63 of the holding portion 6 is mounted on a frame member not illustrated for example as illustrated in FIG. 6. Then, a slide groove 66 extending in the vertical direction is provided in the adjusting member 65, a screw 67 is moved along the slide groove 66, and a fastening amount of the screw 67 is adjusted. Thus, the inclination angles (θ and ϕ) of the separation roller shaft 5 with respect to the feed roller shaft 7 are adjusted.

It is noted that in the present embodiment, the configuration in which the separation roller shaft 5 supporting the separation roller 3 is inclined in the sheet conveying direction by the predetermined angle θ and is inclined in the direction (vertical direction) intersecting the sheet conveying direction by the predetermined angle ϕ. However, it is also possible to adopt a configuration in which the separation roller shaft 5 is inclined only in either one direction of the sheet conveying direction and the direction intersecting the sheet conveying direction depending on a configuration of the apparatus. For instance, it is possible to adopt a configuration in which the separation roller shaft 5 is inclined by a predetermined angle θ (angle other than zero) with respect to the sheet conveying direction and is not inclined in the direction intersecting the sheet conveying direction (predetermined inclination angle ϕ=0).

Furthermore, while the configuration in which the sheet delivered by the pickup roller 1 is conveyed by the feed roller 2 has been described in the above description, the present disclosure is not limited to that. For example, the separation nip portion may be configured of the pickup roller 1 (conveyance roller) and the separation roller 3 and the separation roller 3 may be configured to be able to come into pressure contact with and to separate from the pickup roller 1.

Furthermore, while the frame 10 is formed of the synthetic resin and is configured to be elastically deformable in the present embodiment, the present disclosure is not limited to that. For example, the side plates 61 and 62 may be formed of the elastically deformable synthetic resin and the side plates 61 and 62 may be elastically deformable as the separation roller 3 receives a load from the feed roller 2.

Still further, not only the first and second bearing portions 12 and 13, parts other than the first and second bearing portions 12 and 13 may be elastically deformed. That is, as a configuration in which either part of the support portion 20 including the holding portion 6 and the frame 10 is elastically deformable, the separation roller shaft 5 may be substantially paralleled to the feed roller shaft 7 in feeding the sheet.

Furthermore, although the separation roller 3 is configured to swing in the vertical direction by the holding portion 6 in the present embodiment, the present disclosure is not limited to that. That is, the direction in which the separation roller 3 comes into pressure contact with the feed roller 2 may be the sheet conveying direction and the direction substantially orthogonal to the axial direction of the separation roller 3.

While the present invention has been described with reference to exemplary embodiments, it is to be understood that this disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2013-228592, filed Nov. 1, 2013, which is hereby incorporated by reference herein in its entirety.

What is claimed is:

1. A sheet feeding apparatus comprising:

a conveying roller configured to convey a sheet;

a separation roller configured to come into pressure contact with the conveying roller;

a conveying roller shaft to which the conveying roller is attached;

a separation roller shaft supported in a cantilever condition and to which the separation roller is attached through a torque limiter;

a driving source configured to drive the conveying roller;

a shaft holding portion configured to hold the separation roller shaft;

a swing support shaft mounted on the shaft holding portion in parallel with the separation roller shaft and swingably supporting the separation roller shaft; and an elastically deformable bearing portion supporting the swing support shaft, wherein the bearing portion supports the swing support shaft such that the separation roller shaft is inclined with respect to the conveying roller shaft so that a first end portion of the separation roller shaft, to which the separation roller is attached, is positioned on an upstream side in a sheet conveying direction of a second end portion of the separation roller shaft, and wherein the bearing portion is elastically deformed such that the separation roller shaft is substantially parallel with the conveying roller shaft in a state in which the separation roller receives a force from the conveying roller driven by the driving source.

2. The sheet feeding apparatus according to claim 1, wherein the shaft holding portion includes a pair of side plates holding the separation roller shaft and the swing support shaft in a parallel condition, and the bearing portion supports shaft end portions of the swing support shaft projecting out of the pair of side plates.

3. The sheet feeding apparatus according to claim 1, wherein the bearing portion holds the separation roller in a state in which the separation roller shaft is inclined such that the first end portion of the separation roller shaft is positioned closer to the conveying roller shaft than the second end portion of the separation roller shaft in a pressure contact direction in which the separation roller comes into pressure contact with the conveying roller, and is elastically deformed such that the separation roller shaft is substantially parallel with the conveying roller shaft by a force received by the separation roller from the conveying roller.

4. The sheet feeding apparatus according to claim 1, further comprising an adjusting portion configured to adjust a position where the swing support shaft is mounted on the bearing portion such that an inclination of the separation roller shaft is changed.

5. An image forming apparatus comprising:

an image forming portion configured to form an image on a sheet; and the sheet feeding apparatus as set forth in claim 1 configured to feed the sheet to the image forming portion.

6. A sheet feeding apparatus comprising:

a conveying roller configured to convey a sheet;

a conveying roller shaft supporting the conveying roller;

a separation roller provided to come into pressure contact with the conveying roller;

a separation roller shaft supporting the separation roller at a first end portion thereof through a torque limiter; and a support portion supporting the separation roller shaft in a cantilever condition and formed to be elastically deformable, the support portion supporting the separation roller shaft such that the separation roller shaft is inclined by a predetermined angle with respect to the conveying roller shaft so that the first end portion of the separation roller shaft is positioned upstream in the sheet conveying direction of a second end portion of the separation roller shaft in a state in which the conveying roller is not driven, wherein the support portion is elastically deformed such that the predetermined angle is reduced in a state in which the conveying roller is driven in contact with the separation roller.

7. The sheet feeding apparatus according to claim 6, wherein the support portion supports the separation roller shaft in a state in which the separation roller shaft is inclined by a predetermined angle such that the first end portion is positioned closer to the conveying roller shaft than the second end portion in a pressure contact direction in which the separation roller comes into pressure contact with the conveying roller in the state in which the conveying roller is not driven.

8. The sheet feeding apparatus according to claim 7, wherein the support portion is elastically deformed such that an inclination of the separation roller shaft is reduced in the sheet conveying direction and in the pressure contact direction in the state in which the separation roller is in pressure contact with the conveying roller while the conveying roller is driven.

9. The sheet feeding apparatus according to claim 6, wherein the support portion includes a swing support shaft disposed in parallel with the separation roller shaft and swingably supporting the separation roller shaft, and a bearing portion supporting the swing support shaft in inclination by the predetermined angle in the sheet conveying direction.

10. The sheet feeding apparatus according to claim 9, wherein the bearing portion includes a first bearing portion rotatably supporting a first end portion of the swing support shaft and a second bearing portion rotatably supporting a second end portion of the swing support shaft, and wherein the second end portion is positioned downstream in the sheet conveying direction of the first end portion.

11. The sheet feeding apparatus according to claim 10, wherein the bearing portion is elastically deformed such that an elastic deformation of the first bearing portion becomes greater than that of the second bearing portion in a state in which the conveying roller is driven in pressure contact with the separation roller.

12. The sheet feeding apparatus according to claim 10, wherein the first and second bearing portions support the swing support shaft such that the first end portion of the swing support shaft is positioned closer to the conveying roller shaft than the second end portion in the direction in which the separation roller comes into pressure contact with the conveying roller.

13. The sheet feeding apparatus according to claim 6, wherein the support portion includes a biasing member causing the separation roller to come into pressure contact with the conveying roller.

14. An image forming apparatus comprising:

an image forming portion configured to form an image on a sheet; and the sheet feeding apparatus as set forth in claim 6 configured to feed the sheet to the image forming portion.

* * * * *